US007035569B2

(12) United States Patent
Park

(10) Patent No.: US 7,035,569 B2
(45) Date of Patent: Apr. 25, 2006

(54) MOVABLE PROCESS CARTRIDGE USABLE IN A ONE-PROPERTY CONTACT DEVELOPING PROCESS AND AN IMAGE FORMING APPARATUS EMPLOYING THE SAME

(75) Inventor: Dong-hoon Park, Osan (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 84 days.

(21) Appl. No.: 10/765,873

(22) Filed: Jan. 29, 2004

(65) Prior Publication Data

US 2004/0184835 A1 Sep. 23, 2004

(30) Foreign Application Priority Data

Feb. 20, 2003 (KR) ..... 10-2003-0010810

(51) Int. Cl.
*G03G 15/02* (2006.01)
*G03G 15/04* (2006.01)

(52) U.S. Cl. ..... 399/116; 399/119

(58) Field of Classification Search ..... 399/110, 399/111, 113, 116, 117, 119, 120, 360
See application file for complete search history.

(56) References Cited

U.S. PATENT DOCUMENTS

| | | | | |
|---|---|---|---|---|
| 4,607,939 | A * | 8/1986 | Saito | 399/119 |
| 4,821,063 | A * | 4/1989 | Kaneshige | 399/119 |
| 4,851,873 | A * | 7/1989 | Sakao et al. | 399/119 |
| 5,089,849 | A * | 2/1992 | Hiraoka | 399/119 |
| 5,289,241 | A * | 2/1994 | Sugiyama et al. | 399/120 |
| 5,369,475 | A * | 11/1994 | Kashiwagi | 399/119 |
| 6,741,822 | B1 * | 5/2004 | Ishiguro et al. | 399/119 |
| 6,782,235 | B1 * | 8/2004 | Serizawa et al. | 399/360 |

* cited by examiner

*Primary Examiner*—Sandra L. Brase
(74) *Attorney, Agent, or Firm*—Stanzione & Kim, LLP

(57) ABSTRACT

A process cartridge, which uses a removable cartridge and also a one-property contact system, used with an image forming apparatus, includes a drum cartridge in which a photoconductive drum is disposed in an exposed manner, a toner cartridge in which a developing roller rotating in contact with the photoconductive drum is mounted in an exposed manner, and supporting members supporting and guiding the toner cartridge so that the developing roller moves linearly with respect to the photoconductive drum. The supporting members are made stationary in predetermined positions of the main body, and a developing nip between the photoconductive drum and the developing roller is controlled as the toner cartridge is moved linearly with respect to the supporting member within a predetermined distance range.

38 Claims, 6 Drawing Sheets

MOVABLE PROCESS CARTRIDGE USABLE IN A ONE-PROPERTY CONTACT DEVELOPING PROCESS AND AN IMAGE FORMING APPARATUS EMPLOYING THE SAME

CROSS-REFERENCE TO RELATED APPLICATIONS

This application claims the benefit of Korean Application No. 2003-10810, filed Feb. 20, 2003, in the Korean Intellectual Property Office, the disclosure of which is incorporated herein by reference.

BACKGROUND OF THE INVENTION

1. Field of the Invention

The present invention relates to an electrophotographic image forming apparatus, and more particularly, to an electrophotographic image forming apparatus employing a one-property contact developing system, and a process cartridge used with the electrophotographic image forming apparatus.

2. Description of the Related Art

A general electrophotographic image forming apparatus such as a laser printer, a copier or a facsimile, projects a laser beam to form an electrostatic latent image on a photoconductive drum, and develops the electrostatic latent image into a visible image by supplying a toner thereto using a developing system. The visible image which is developed on the photoconductive drum is conveyed to a printing paper, which passes through a transfer nip defined between the photoconductive drum and a transfer roller, and then is developed on the printing paper at a fusing unit by heat and pressure. Thus, a printing operation is completed.

The above developing system which develops the electrostatic latent image into the visible image by supplying the toner to the photoconductive drum can be divided into a contact developing system and a non-contact developing system. The contact developing system uses a one-property toner while the non-contact developing system uses a two-property toner. The contact developing system is quieter and more power-saving than the non-contact developing system. Further, the contact developing system has advantages such as having a smaller cartridge and a higher resolution.

However, the quantity of the one-property toner which is moved to the photoconductive drum to develop an electrostatic latent image in the contact system is greatly influenced by a contacting area (hereinafter, referred to as 'developing nip') of the photoconductive drum and developing roller. Therefore, when the developing nip between the photoconductive drum and the developing roller is sufficient, a printed image of a good quality can be obtained even in the contact developing system. According to an experiment, a substantially allowable range of developing nip, that is, an overlapping outer circumference of the developing roller and the photoconductive drum on a line connecting the centers thereof, in the contact developing system is +0.05 mm~+0.1 mm. When developing nip area is beyond the allowable range, various problems may occur on a printed image.

Accordingly, to prevent the problems, an integral process cartridge has been used, in which a toner supply unit storing and supplying the toner, and a developing unit forming and developing an image are integrally formed.

An example of such an integral process cartridge is illustrated in FIG. 1. Referring to FIG. 1, in the integral process cartridge, a developing unit and a toner supplying unit are mounted in a cartridge housing 10. In the cartridge housing 10, a cleaning blade, an electrifying roller 12, and a developing roller 13 are mounted in order around the photoconductive drum 11. In addition, in the cartridge housing 10, a waste toner chamber 10*a* is disposed on one side of the photoconductive drum 11, and a toner chamber 10*b* is disposed on the other side of the photoconductive drum 11.

According to the above structure of the integral process cartridge, the photoconductive drum 11 is electrified by the electrifying roller 12, and then an electrostatic latent image is formed on a surface of the photoconductive drum 11 by a predetermined laser beam 14 which is projected from a laser scan unit (not shown). Then, as the photoconductive drum 11 rotates, the electrostatic latent image is developed into a predetermined visible image by the toner which is conveyed by the developing roller 13. The visible image is transferred onto a printing paper P which passes between the photoconductive drum 11 and the transfer roller 20.

Accordingly, since the developing nip between the developing roller 13 and the photoconductive drum 11 is maintained by the cartridge housing 10 regularly in an electrophotographic image forming apparatus using the integral process cartridge, an image of good quality is obtained.

However, a defect of the integral process cartridge is having to replace the whole process cartridge when only the toner in the toner supplying unit is used up while the developing unit including the photoconductive drum is still usable. As a result, the integral process cartridge is more wasteful and costly.

SUMMARY OF THE INVENTION

Accordingly, it is an aspect of the present invention to provide a process cartridge of a one-property contact system of which a developing unit and a toner supplying unit are separate, and a developing nip between a developing roller and a photoconductive drum is consistent, thus enabling an efficient use of one-property toner.

Another aspect of the present invention is to provide an electrophotographic image forming machine employing the process cartridge of the one-property contact system.

Additional aspects and advantages of the invention will be set forth in part in the description which follows and, in part, will be obvious from the description, or may be learned by practice of the invention.

In order to achieve the above and/or other aspects of the present invention, there is provided a process cartridge, which is mounted in a main body of an image forming apparatus to supply a toner to a developing roller to develop an electrostatic latent image, which is formed on a photoconductive drum, the process cartridge comprising a drum cartridge having the photoconductive drum in an exposed manner and mounted in a direction of an axis of the photoconductive drum with respect to the main body, a toner cartridge, in which the developing roller rotating in contact with the photoconductive drum is mounted in an exposed manner, the toner cartridge being mounted in the main body to be disposed opposite to the drum cartridge, and supporting members mounted on both sides of the toner cartridge, and supporting and guiding the toner cartridge so that the developing roller moves linearly with respect to the photoconductive drum, the supporting members being disposed stationary in predetermined positions of the main body, and a developing nip between the photoconductive drum and the developing roller being controlled as the toner cartridge is moved linearly with respect to the supporting member within a predetermined distance range.

Here, the supporting members comprise position determining units formed stationary at predetermined positions of the main body to secure the supporting members in the predetermined positions of the main body. The position determining unit comprises at least a pair of position determining holes formed on an upper side of the supporting member to be coupled with position determining pins which are formed at predetermined positions of the main body. It is possible that one of the supporting members mounted on both sides of the toner cartridge is used as a waste toner container to contain a waste toner discharged from the drum cartridge.

Further, the toner cartridge comprises at least two guiding shafts or guiding holes formed on both sides thereof, and the supporting members comprise guiding holes or guiding shafts guiding the guiding shafts or guiding holes such that the developing roller of the toner cartridge is moved linearly along the photoconductive drum. Here, the guiding shafts respectively comprise rolling contact members contacting the guiding holes, and each of the rolling contact members is a cylindrical bearing. Here, one of the supporting members mounted on both sides of the toner cartridge is used as a waste toner container to contain a waste toner discharged from the drum cartridge.

In addition, the toner cartridge further comprises a flexible coupling to which a rotation force is transmitted from the main body even when the toner cartridge is moved together with the supporting members in the main body. Here, the flexible coupling comprises a coupling body connected to a driving source of the main body, a coupling gear connected to a passive gear of the toner cartridge, and a medium disc transferring power of the driving source and causing the coupling gear to move by a predetermined distance in a radial direction of the medium disc.

The above and/or other aspects of the present invention may also be achieved by providing an image forming apparatus which comprises a main body which has first and second cartridge mounting portions fluidly (spatially) communicating with each other, a drum cartridge removably mounted in the first mounting portion and having a photoconductive drum which is exposed outward, a toner cartridge removably mounted in the second mounting portion and having a developing roller exposed outward, the toner cartridge being mounted without interruption between the developing roller and the photoconductive drum, and to contact the photoconductive drum when being completely mounted, supporting members mounted on both sides of the toner cartridge to support and guide the toner cartridge so that the developing roller is moved linearly with respect to the photoconductive drum, and a pressing unit maintaining a predetermined developing nip between the photoconductive drum and the developing roller by pressing the toner cartridge toward the photoconductive drum when the toner cartridge is mounted in the second cartridge mounting portion.

Here, the supporting members comprise position determining units formed stationary in predetermined positions of the main body to secure the supporting members in the predetermined positions of the main body. The position determining unit comprises at least a pair of position determining holes formed on an upper side of the supporting member to be coupled with position determining pins formed at predetermined positions of the main body. Further, one of the supporting members mounted on both sides of the toner cartridge is used as a waste toner container to contain a waste toner discharged from the drum cartridge.

In addition, the toner cartridge comprises at least two guiding shafts or guiding holes formed on both sides thereof, and the supporting members comprise guiding holes or guiding shafts to guide the guiding shafts or guiding holes such that the developing roller of the toner cartridge is moved linearly along the photoconductive drum. Here, the guiding shafts respectively comprise rolling contact members contacting the guiding holes, and each of the rolling contact members is a cylindrical bearing. Here, it is also possible that one of the supporting members mounted on both sides of the toner cartridge is used as a waste toner container to contain a waste toner discharged from the drum cartridge.

According to another aspect of the present invention, the toner cartridge further comprises a flexible coupling to which a rotation force is transmitted from the main body even when the toner cartridge is moved together with the supporting members in the main body. Here, the flexible coupling comprises a coupling body connected to a driving source of the main body, a coupling gear connected to a passive gear of the toner cartridge, and a medium disc transferring power of the driving source and causing the coupling gear to move by a predetermined distance in a radial direction of the medium disc.

BRIEF DESCRIPTION OF THE DRAWINGS

These and other aspects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
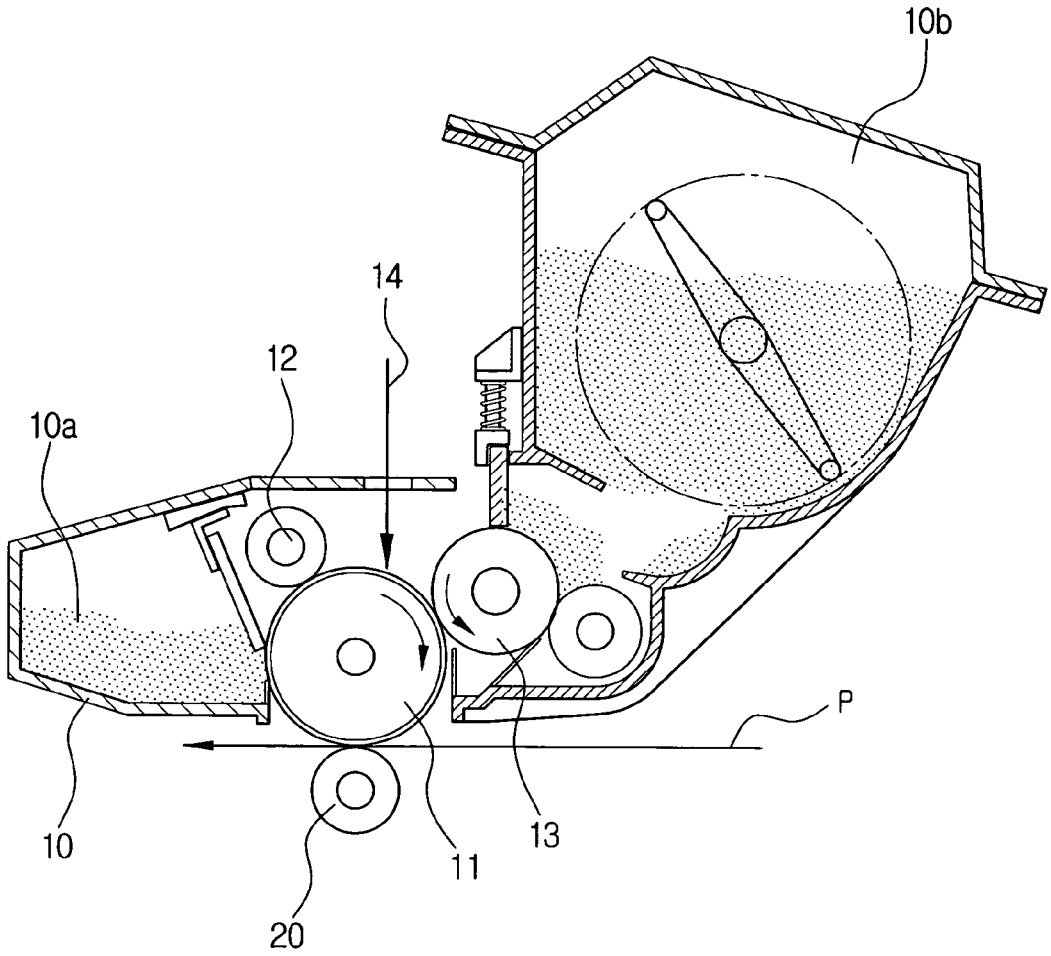
FIG. 1 (PRIOR ART)
FIG. 1 is a cross-sectional view of a conventional process cartridge in an image forming apparatus which employs a one-property toner.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Referring to FIGS. 2 through 6, an image forming apparatus according to an embodiment of the present invention comprises a main body 100, a process cartridge, and a pressing unit.

The main body 100 comprises a first cartridge mounting portion 110 to removably mount a drum cartridge 200 therein, and a second cartridge mounting portion 120 fluidly (spatially) communicating with the first cartridge mounting portion 110 to mount a toner cartridge 300 therein. The first and second cartridge mounting portions 110 and 120 are closed/open by a front door 130.

The process cartridge comprises the drum cartridge 200, the toner cartridge 300, and supporting members 330 and 340.

The drum cartridge 200 comprises a cartridge housing 210, and a photoconductive drum 220 which is exposed out of the cartridge housing 210 thorough an opening formed on the cartridge housing 210. Referring to the FIG. 3, an electrifying roller 214, a cleaning blade 213, and a cleaning roller 215 are mounted in the cartridge housing 210. Position determining holes 211 and 212 are formed on a front part of the cartridge housing 210 to be coupled with position determining pins 111 and 112 which are formed around the first cartridge mounting portion 110. Further, a toner outlet (not shown) is formed on a lower portion of the front part of the cartridge housing 210 to be open/closed, and a waste toner is discharged to a waste toner cartridge (one of the supporting members 330 and 340) through the toner outlet after being collected at the photoconductive drum 220 in the cartridge housing 210. Since a structure of the toner outlet is well-known in the art, a detailed description will be omitted.

Figure 3:
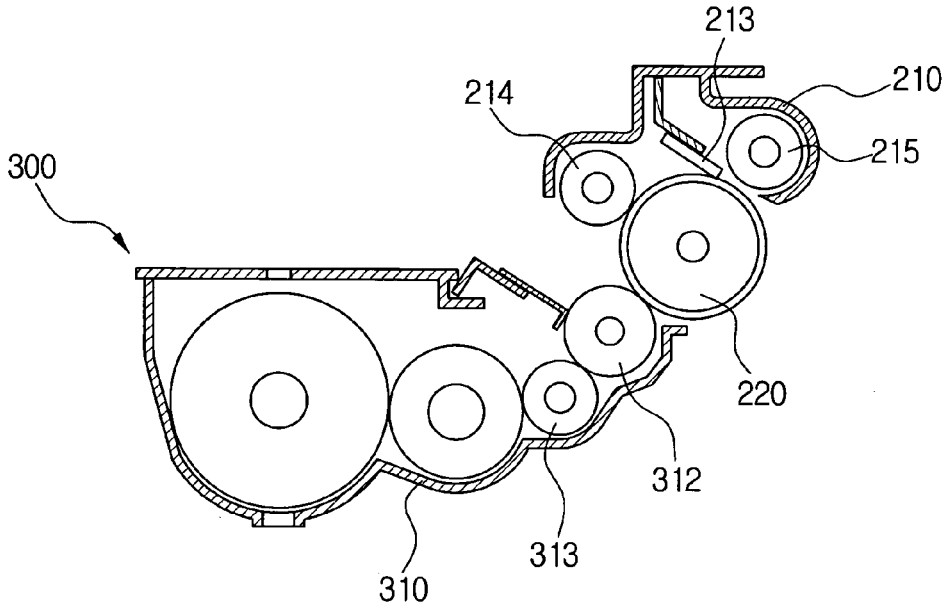
FIG. 3 is a cross-sectional view of a toner cartridge and a drum cartridge of the image forming apparatus shown in FIG. 2.
Figure 6:
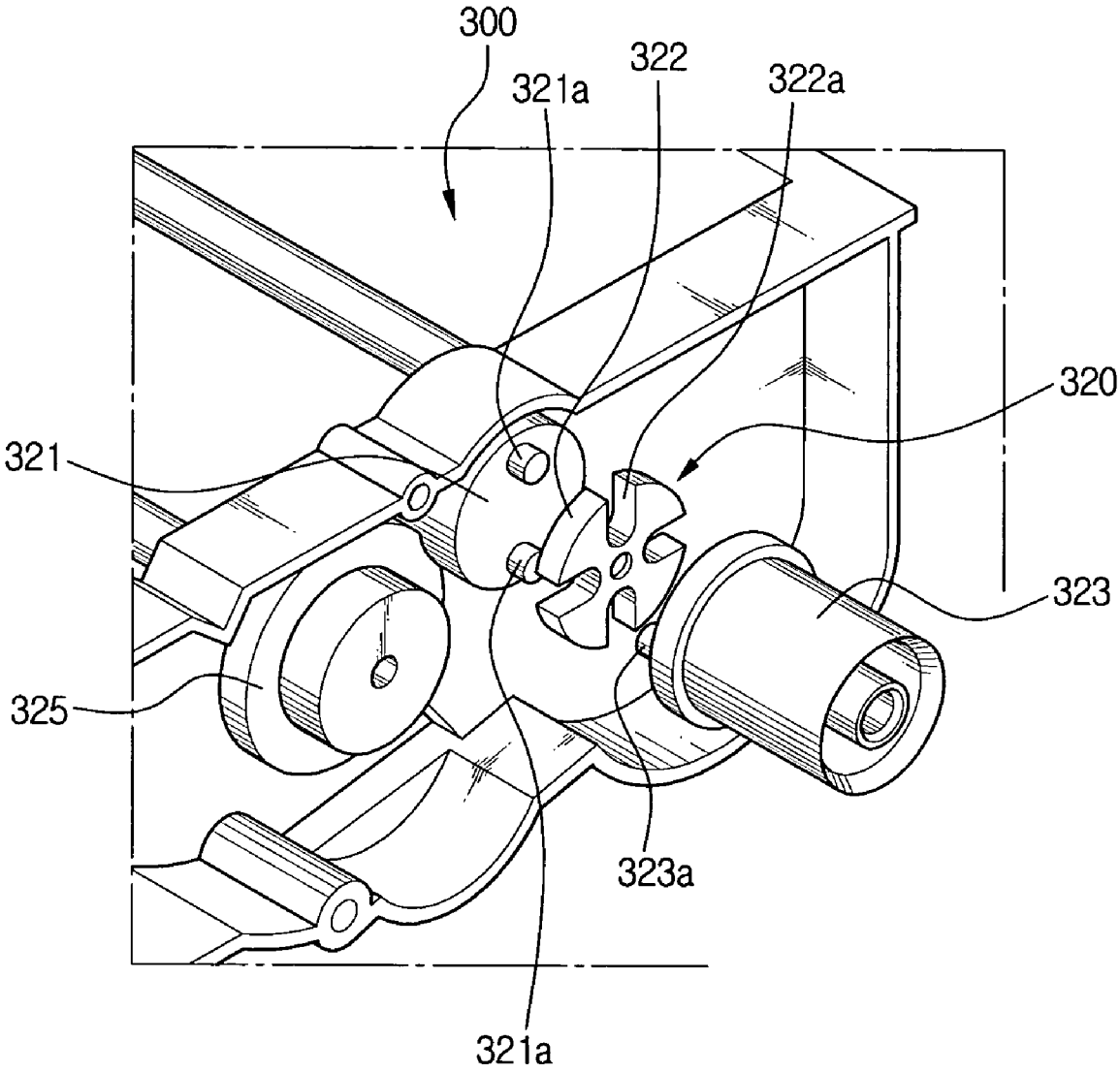
FIG. 6 is a perspective view separately showing a flexible coupling of the toner cartridge of FIGS. 2–5.

The toner cartridge 300 is mounted on the second cartridge mounting portion 120 and includes a case 310 to store the toner, and a developing roller 312 rotatably assembled with the case 310 as shown in FIG. 3. The developing roller 312 is mounted to be partially exposed out of the case 310 through an opening formed on the case 310, and upon being mounted on the second cartridge mounting portion, rotates in contact with the photoconductive drum 220 while defining a predetermined developing nip there between. The developing roller 312 receives the toner stored in the case 310 from a toner supplying roller 313 and supplies the toner to the photoconductive drum 220. In addition, a flexible coupling 320 is mounted on one side of the case 310, as shown in FIG. 6, to rotate the developing roller 312 and the toner supplying roller 313 according to a power supplied from the main body 100 of the image forming apparatus.

The flexible coupling 320 comprises a coupling body 323 assembled to a driving source, such as a motor, mounted in the main body 100 of the image forming apparatus, a coupling gear 321 connected to a passive gear 325 of the toner cartridge 300, and a medium disc 322 assembled between the coupling body 323 and the coupling gear 321. The coupling body 323 and the coupling gear 321 have respectively two connecting pins 321*a* and 323*a*, formed in a symmetrical fashion to correspond to connecting grooves 322*a* as shown in FIG. 6. The medium disc 322 has four connecting grooves 322*a* formed at right angles about a center thereof to receive the connecting pins 323*a* and 321*a* of the coupling body 323 and the coupling gear 321. The connecting grooves 322*a* are formed long enough to allow the connecting pins 321*a* and 323*a* to move by a predetermined distance therealong. Therefore, when the toner cartridge 300 moves by a predetermined distance with respect to the coupling body 323, which is fixed to the driving source of the main body 100, the coupling gear 321, which is mounted on the toner cartridge 300, moves with respect to the connecting grooves 322*a* of the medium disc 322. Thus, the power of the driving source is transferred to the passive gear 325 of the toner cartridge 300. Here, the passive gear 325 of the toner cartridge 300 refers to a gear mounted outside of the toner cartridge 300 to rotate the developing roller 312 and the toner supplying roller 313 of the toner cartridge 300.

Figure 4:
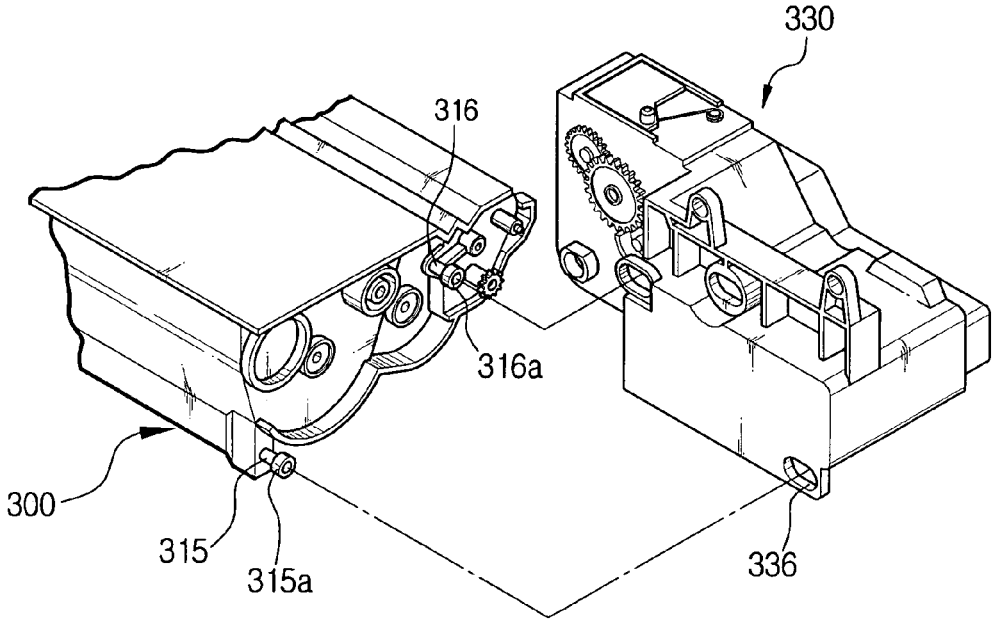
FIG. 4 is a schematic perspective view of a waste toner chamber and the toner cartridge of the image forming apparatus shown in FIG. 2.

The supporting members 330 and 340 are fixed on the main body 100 of the image forming apparatus to support and guide the toner cartridge 300 so as to move linearly with respect to the drum cartridge 200 in the second cartridge mounting portion 120. In the supporting members 330 and 340, a guide shaft or a guide hole guiding a movement of the toner cartridge 300 is formed. As shown in FIG. 4, when the guiding shafts 315 and 316 protrude beyond the toner cartridge 300, there are guiding holes 335 and 336 formed in the supporting member 330 to guide the guiding shafts 315 and 316. When the guiding holes 335 and 336 are formed on the toner cartridge 300, the guiding shafts 315 and 316 formed on the supporting member 330 are inserted in the guiding holes 335 and 336, respectively, to guide the toner cartridge 300. Here, rolling contact members 315*a* and 316*a* are formed on the guiding shafts 315 and 316 to reduce friction of the shafts 315 and 316 in the guiding holes 335 and 336, respectively. The rolling contact members 315*a* and 316*a* are preferably a cylindrical bearing. Further, it is an aspect that two guiding shafts and guiding holes are formed respectably at a predetermined distance so that the toner cartridge 300 can stably move back and forth within the main body 100.

Figure 2:
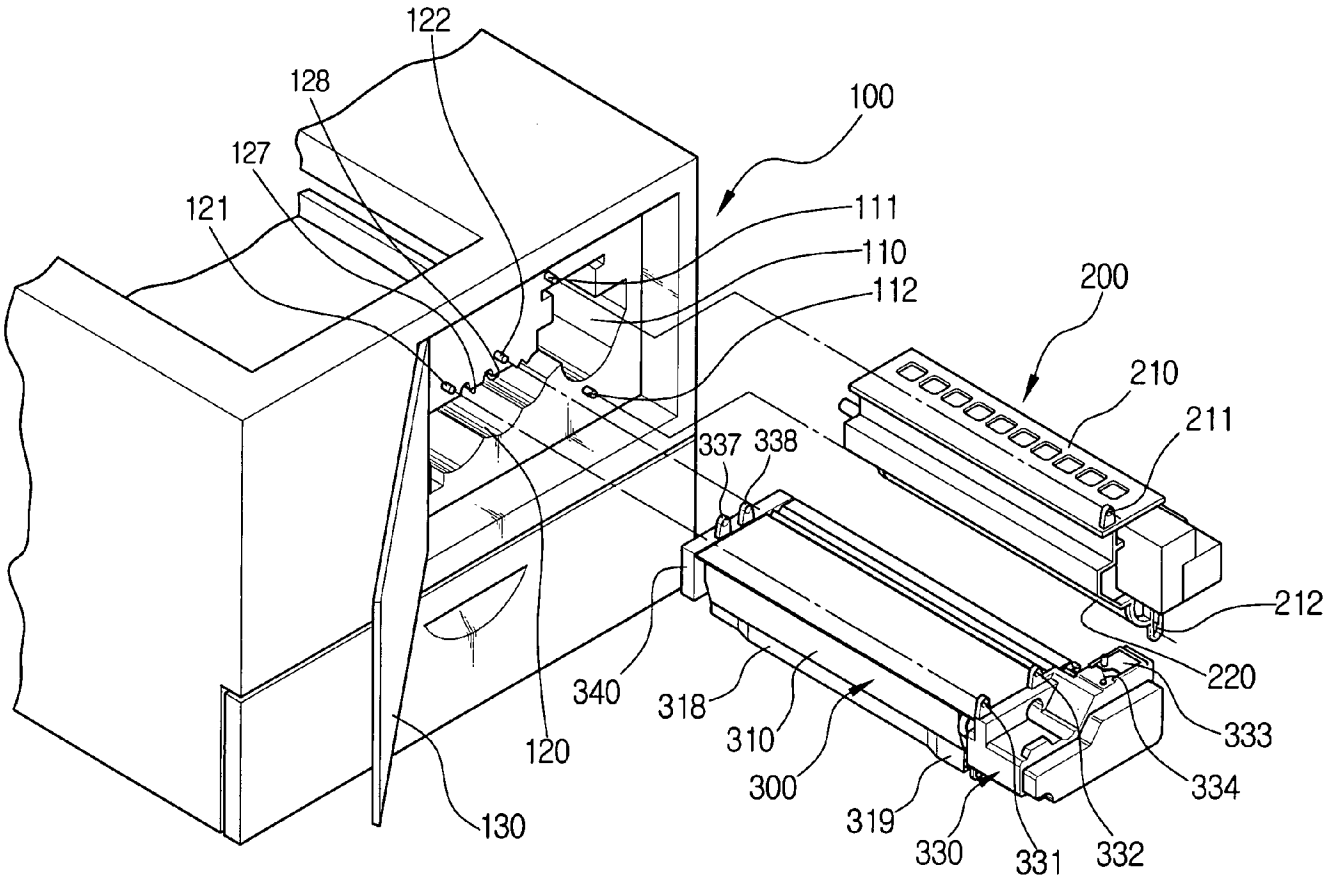
FIG. 2 is a perspective view of an image forming apparatus according to an embodiment of the present invention.

The supporting members 330 and 340 are mounted on both sides of the toner cartridge 300, and one end of respective supporting members 330 and 340 can be securely mounted on the main body 100. Alternatively, the supporting members 330 and 340 can be mounted on the main body 100 being already assembled with both sides of the toner cartridge 300. Here, it is aspect that the waste toner container, containing the waste toner collected from the drum cartridge 200, is employed in the supporting member 330, which is to be mounted on a portion disposed at an inside of the front door 130. FIG. 2 shows an example of the supporting members 330 and 340 in which the supporting member 340 is employed to be disposed at an inside of the second cartridge mounting portion 120, and the waste toner container 330 is employed to be disposed at the inside of the front door. Hereinafter, the supporting member 330 is referred to as the waste toner container 330.

The waste toner container 330 is fixed at an entrance of the second cartridge mounting portion 120. A fixing unit is employed to fixedly couple the waste toner container 330 to the main body 100 of the image forming apparatus. The fixing unit has a pair of position determining pins 121 and 122 formed around the second cartridge mounting portion 120 of the main body 100, and position determining holes 331 and 332 formed outside of the waste toner container 330 to correspond to the position determining pins 121 and 122. That is, the position determining pins 121 and 122 are assembled with the position determining holes 331 and 332, and thereby the waste toner container 330 is securely fixed on the main body 100. On the other hand, on an upper part of the waste toner container 330, an open/close cover 333 is slidably formed to open/close an inlet of the waste toner container 330 to receive and contain the waste toner discharged from the drum cartridge 200 through the toner outlet of the cartridge housing 210. The open/close cover 333 is slid open by contact with an outside of the drum cartridge 200 when the toner cartridge 300 is mounted on the second cartridge mounting portion 120. The open/close cover 333 is closed by a recovery force of a spring 334 when the toner cartridge 300 is separated from the main body 100.

The supporting member 340 is fixed inside the second cartridge mounting portion 120, that is, to an opposite side to the waste toner container 330. Another fixing unit is employed to fix the supporting member 340 on the main body 100. The another fixing unit has a pair of position determining pins (not shown) formed inside the second cartridge mounting portion 120 of the main body 100, and a pair of position determining holes 337 and 338 formed outside of the supporting member 340 to correspond to the position determining pins (not shown). The position determining holes 337 and 338 are formed on portions of the support member 340, and guiding grooves 127 and 128 are formed on the main body 100 to correspond to the portions of the support member 340. The portions of the support member 340 slide along corresponding ones of the guiding grooves 127 and 128 when the toner cartridge 300 is inserted into the main body 100. That is, the position determining pins (not shown) are assembled with the position determining holes 337, 338, and thereby the supporting member 340 is securely fixed to the main body 100.

The pressing unit maintains the developing nip between the photoconductive drum 220 and the developing roller 312 by pressing the toner cartridge 300 toward the photoconductive drum 220 when the toner cartridge 300 is mounted in the second cartridge mounting portion 120. The pressing unit comprises first and second moving members 141 and 143 mounted to move inside the second cartridge mounting portion 120, and first and second pressing springs 151 and 153 to press the respective moving members 141 and 143 toward the toner cartridge 300. The first and the second moving members 141 and 143 are pushed by the first and the second pressing springs 151 and 153 respectively, to press each of stepped portions 318 and 319 of the toner cartridge 300.

Hereinafter, an operation of the image forming apparatus according to the embodiment of the present invention will be described in detail with reference to the accompanying drawings.

Figure 7A:
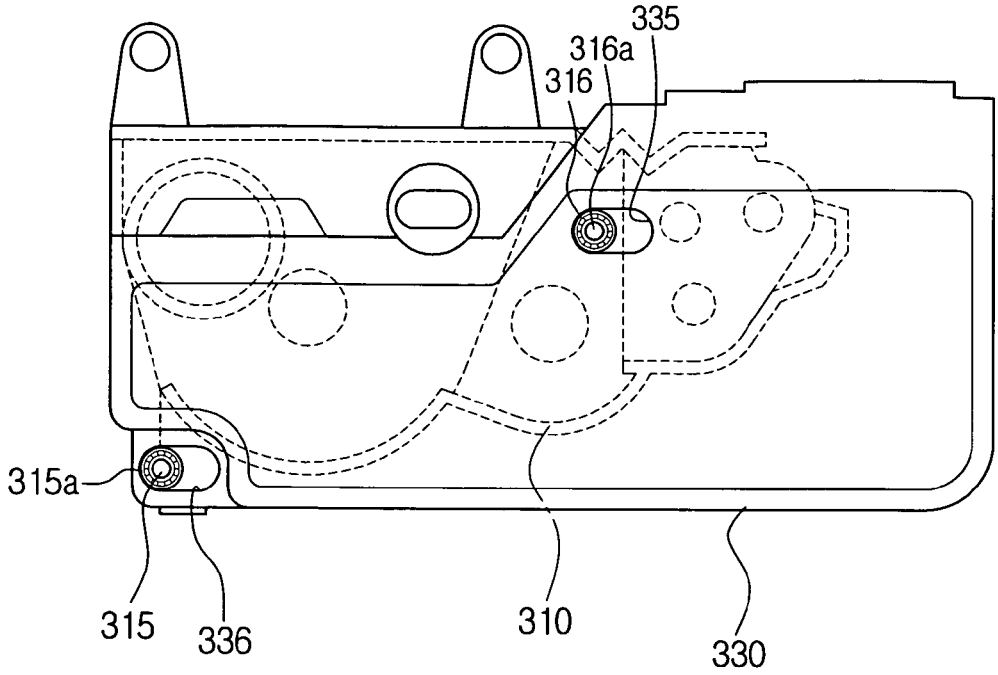
FIGS. 7A and 7B are front views of the toner cartridge of FIGS. 2–5 which is assembled to a supporting member shown in FIG. 2.

In FIG. 2, the drum cartridge 200 is inserted in a lengthwise direction into the first cartridge mounting portion 110. Then, the toner cartridge 300 is inserted in a lengthwise direction within the second cartridge mounting portion 120. Here, the toner cartridge 300 is inserted in a manner that the guiding shafts 315 and 316 are inserted from left ends of the guiding holes 335 and 336 of the waste toner container 330, as shown in FIG. 7A. When the toner cartridge 300 is positioned within the second cartridge mounting portion 120, the stepped portions 318 and 319 of the toner cartridge 300 are pushed toward the drum cartridge 200 to contact the first and the second moving members 141 and 143 of the pressing unit. In the initial operation, the developing roller 312 of the toner cartridge 300 does not contact the photoconductive drum 220 of the mounted drum cartridge 200 yet. Then as the developing roller 312 is completely mounted, the toner cartridge 300 is pushed toward the drum cartridge 300 by the pressing unit, and thus the developing roller 312 comes in contact with the photoconductive drum 220. Further, when the toner cartridge 300 is completely inserted with the second cartridge mounting portion 120, the waste toner container 330 and the supporting members 340 are securely fixed on the main body 100 by the position determining pins 121 and 122 and the portions having the position determining holes 331 and 332 as well as by the position determining pins (not shown) and the portions having the position determining holes 337 and 338.

Figure 5:
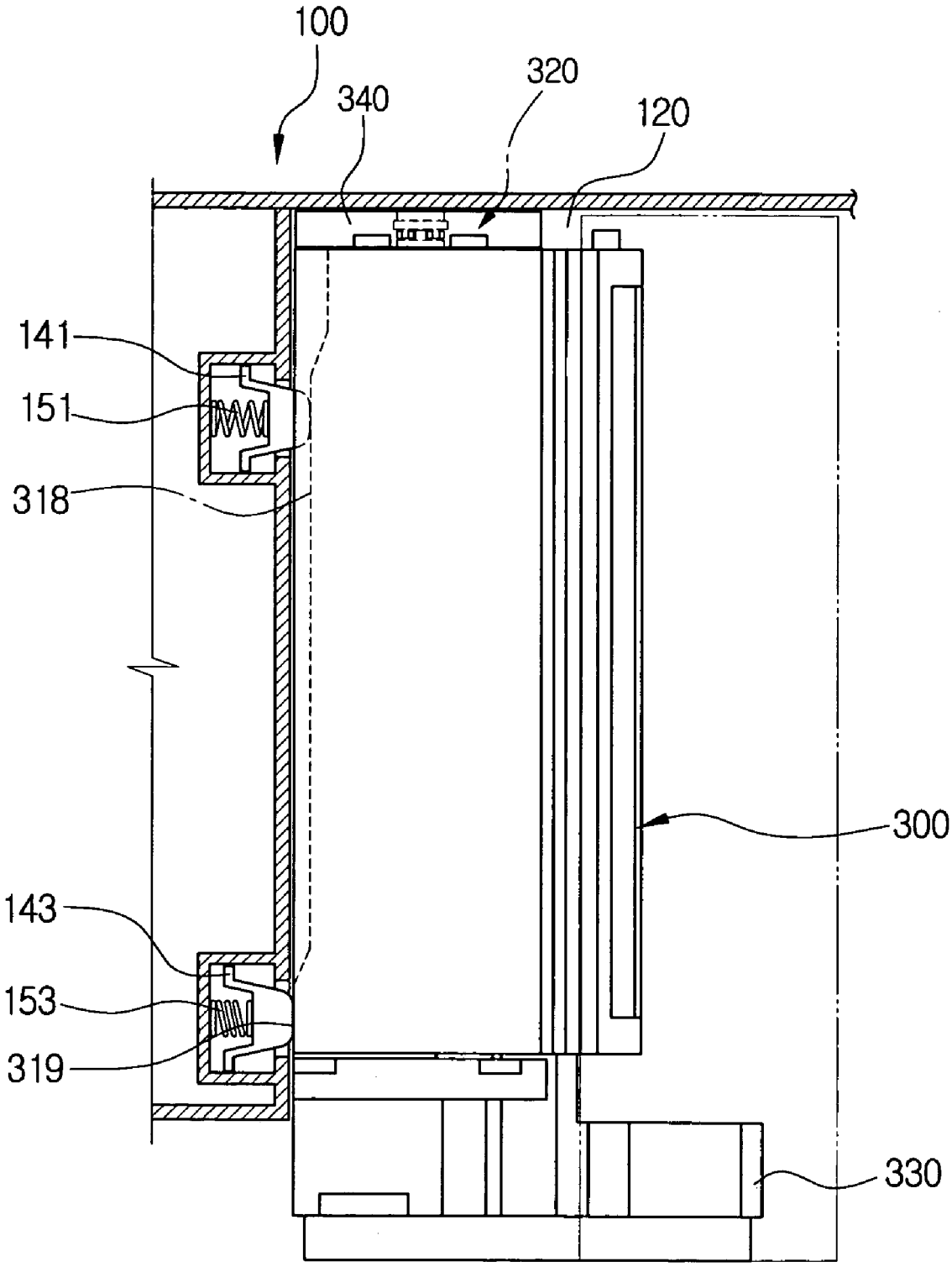
FIG. 5 is a schematic sectional view partially showing the toner cartridge of FIGS. 2–4 mounted in the image forming apparatus shown in FIG. 2.
Figure 7B:
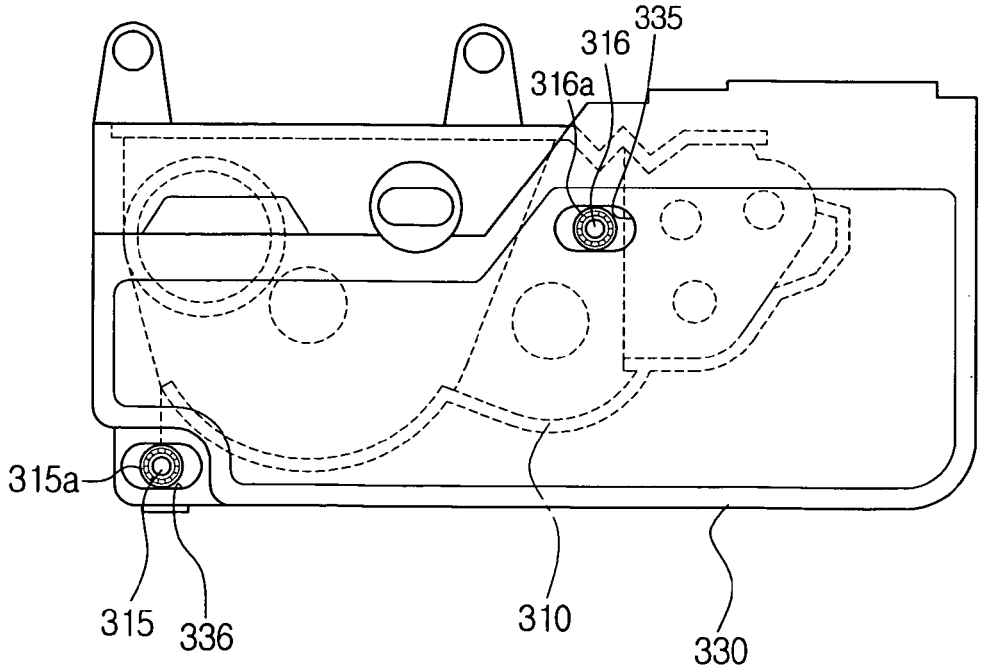

Meanwhile, since the toner cartridge 300 is mounted to move linearly back and forth with respect to the waste toner container 330, the toner cartridge 300 is moved horizontally by the moving members 141 and 143 of the pressing unit. That is, the toner cartridge 300 is pushed rightward with respect to the flexible coupling 320 inside the main body 100, as shown in FIG. 5. After the toner cartridge 300 is inserted into the main body 100, the guiding shafts 315 and 316 of the toner cartridge 300 are at right ends of the guiding holes 336 and 335, as shown in FIG. 7B. Thus, by a horizontal movement of the toner cartridge 300 upon being mounted into the second cartridge mounting portion 120, the developing roller 312 comes into tight contact with the photoconductive drum 220 to form the predetermined developing nip therebetween. In this state, the developing roller 312, which is assembled with the toner cartridge 300, contacts a surface of the photoconductive drum 220, which is assembled with the drum cartridge 200, by a horizontal component of an elastic force of the pressing springs 151 and 153 of the pressing unit of the main body 100.

Although the toner cartridge 300 is moved horizontally by the pressing unit, a rotation force of the driving source of the main body 100 is transferred to the passive gear 325 of the toner cartridge 300 through the flexible coupling 320. In other words, the medium disc 322 of the flexible coupling 320 moves according to the horizontal movement of the toner cartridge 300, and thus the rotation force of the coupling body 323, which is assembled with the driving source, is transferred to the coupling gear 321, which is assembled with the passive gear 325. That is, according to the rotation force of the driving source of the main body 100, the coupling body 323 rotates. If the coupling body 323 rotates, the connecting pins 323*a* on the coupling body 323 accordingly rotate. Then, the medium disc 322, coupled with the connecting pins 323*a*, rotates according to a rotation of the connecting pins 323*a*. Then, the connecting pins 321*a* of the coupling gear 321, which are coupled with the medium disc 322 at a rectangular angle with the connecting pins 323*a*, rotate accordingly together with the medium disc 322. Then, the coupling gear 321 rotates according to the rotation of the connecting pins 321*a*, and thus the passive gear 325 rotates. According to a rotation of the passive gear 325, the developing roller 312 and the toner supplying roller 313 of the toner cartridge 300 rotate and supply toner to the photo conductive drum 220.

As the photoconductive drum 220 and the developing roller 312 rotate by the power received from the driving source, with respect to the surface of the photoconductive drum 220, the developing roller 312 moves horizontally as much as a displacement corresponding to a sum of rotation variations according to rotation concentricity of the photoconductive drum 220 and the developing roller 312 and rotates in contact with the surface of the photoconductive drum 220 under a regular force. Therefore, the developing roller 312 rotates while in contact with the photoconductive drum 220 to maintain a regular developing nip, and also minutely moves in a horizontal direction together with the toner cartridge 300. By the above described operation, various problems can be solved, such as image defects caused by vibration of the photoconductive drum 220 and the developing roller 312 and by a positional deviation of the toner cartridge 300 due to an accumulated dimensional tolerance of the respective components therein.

As described above, according to the present invention, the toner cartridge 300 is pushed by a regular pressure toward the drum cartridge 200, and therefore, the developing roller 312 and the photoconductive drum 220 can maintain the regular developing nip. In addition, since a driving force of the main body 100 is transferred to the toner cartridge 300 by the flexible coupling 320, the developing roller 312 is able to supply the toner stably regardless of the position of the toner cartridge 300 with respect to the main body 100.

According to the present invention, there is obtained various advantages of using a one-property toner, such as lower noise or lower power consumption and/or a smaller process cartridge having a higher resolution. Moreover, the waste of resources and printing costs can be reduced since a life span of parts to be replaced is lengthened by using the removable cartridge.

According to the process cartridge of the present invention, since the developing unit and the toner supplying unit are separate, and the developing nip between the developing roller and the photoconductive drum is regular, the one-property toner can be employed for printing.

Further, according to the present invention, there is provided the image forming apparatus employing a removable process cartridge of a one-property contact developing system which is quieter and more power-saving with a smaller cartridge and high resolution than a conventional system, and thus the wasted resources and the printing costs can be reduced since the life span of the parts is lengthened.

While the invention has been shown and described with reference to certain preferred embodiments thereof, it will be understood by those skilled in the art that various changes in form and details may be made therein without departing from the spirit and scope of the invention as defined by the appended claims and their equivalents.

What is claimed is:

1. A process cartridge, which is mounted in a main body of an image forming apparatus to supply a toner to a developing roller to develop an electrostatic latent image which is formed on a photoconductive drum, comprising:

a drum cartridge in which the photoconductive drum is disposed in an exposed manner, the drum cartridge being mounted in a direction parallel to a longitudinal axis of the photoconductive drum with respect to the main body;

a toner cartridge in which the developing roller rotating in contact with the photoconductive drum is mounted in an exposed manner, the toner cartridge being mounted in the main body to be disposed opposite to the drum cartridge; and supporting members mounted on both sides of the toner cartridge, and supporting and guiding the toner cartridge so that the developing roller moves linearly with respect to the photoconductive drum, wherein the supporting members are stationary at predetermined positions of the main body, and a developing nip between the photoconductive drum and the developing roller is controlled as the toner cartridge is moved toward the photoconductive drum linearly with respect to the supporting members within a predetermined distance range.

2. The process cartridge of claim 1, wherein the supporting members comprise position determining units formed stationary at predetermined positions of the main body to secure the supporting members on the main body.

3. The process cartridge of claim 2, wherein each position determining unit comprises at least a pair of position determining holes formed on an upper side of the supporting members and position determining pins formed at predetermined positions of the main body to be inserted into corresponding ones of the position determining holes.

4. The process cartridge of claim 3, wherein one of the supporting members mounted on both sides of the toner cartridge is a waste toner container to contain a waste toner discharged from the drum cartridge.

5. The process cartridge of claim 1, wherein the toner cartridge comprises at least two guiding shafts formed on both sides thereof, and the supporting members comprise guiding holes to guide the guiding shafts such that the developing roller of the toner cartridge is moved linearly along the length of the photoconductive drum.

6. The process cartridge of claim 5, wherein the guiding shafts respectively comprise rolling contact members to be inserted into the guiding holes.

7. The process cartridge of claim 1, wherein the toner cartridge comprises at least two guiding holes formed on both sides thereof, and the supporting members comprise guiding shafts to guide the guiding shafts such that the developing roller of the toner cartridge is moved linearly along the photoconductive drum.

8. The process cartridge of claim 7, wherein the guiding shafts respectively comprise rolling contact members to contain the guiding holes.

9. The process cartridge of claim 8, wherein each of the rolling contact members is a cylindrical bearing.

10. The process cartridge of claim 9, wherein one of the supporting members mounted on both sides of the toner cartridge is a waste toner container to receive and contain a waste toner discharged from the drum cartridge.

11. The process cartridge of claim 1, wherein the toner cartridge further comprises a flexible coupling to which a rotation force is transmitted from the main body even when the toner cartridge is moved together with the supporting members along the photo conductive drum.

12. The process cartridge of claim 11, wherein the flexible coupling comprises:

a coupling body connected to a driving source of the main body;

a coupling gear connected to a passive gear of the toner cartridge; and a medium disc to transfer a power of the driving source and to cause the coupling gear to move by a predetermined distance in a radial direction of the medium disc.

13. An image forming apparatus comprising:

a main body having first and second cartridge mounting portions spatially communicating with each other;

a drum cartridge removably mounted in the first mounting portion, and having a photoconductive drum exposed outward;

a toner cartridge removably mounted in the second mounting portion, and having a developing roller exposed outward, the toner cartridge being mounted without interruption between the developing roller and the photoconductive drum and contacting the photoconductive drum when completely mounted in the second mounting portion;

supporting members mounted on both sides of the toner cartridge to support and guide the toner cartridge so that the developing roller moves linearly with respect to the photoconductive drum; and a pressing unit to maintain a predetermined developing nip between the photoconductive drum and the developing roller by pressing the toner cartridge toward the photoconductive drum when the toner cartridge is mounted in the second cartridge mounting portion.

14. The image forming machine of claim 13, wherein the supporting members comprise position determining units formed stationary at predetermined positions of the main body to secure the supporting members on the predetermined positions of the main body.

15. The image forming machine of claim 14, wherein each of the position determining units comprises at least a pair of position determining holes formed on an upper side of the supporting member, and position determining pins which are formed at predetermined positions of the main body to be inserted into corresponding ones of the position determining holes.

16. The image forming machine of claim 15, wherein one of the supporting members mounted on both sides of the toner cartridge is a waste toner container to contain a waste toner discharged from the drum cartridge.

17. The image forming machine of claim 13, wherein the toner cartridge comprises at least two guiding shafts formed on both sides thereof, and the supporting members comprise guiding holes to guide the guiding shafts such that the developing roller of the toner cartridge is moved linearly along the length of the photoconductive drum.

18. The image forming machine of claim 17, wherein the guiding shafts respectively comprise rolling contact members to be inserted into the guiding holes.

19. The image forming machine of claim 18, wherein each of the rolling contact members is a cylindrical bearing.

20. The image forming machine of claim 19, wherein one of the supporting members mounted on both sides of the toner cartridge is a waste toner container to receive and contain toner discharged from the drum cartridge.

21. The image forming machine of claim 13, wherein the toner cartridge comprises at least two guiding holes formed on both sides thereof, and the supporting members comprise guiding shafts to guide the guiding shafts such that the developing roller of the toner cartridge is moved linearly along the length of the photoconductive drum.

22. The image forming machine of claim 21, wherein the guiding shafts respectively comprise rolling contact members to be inserted into the guiding holes.

23. The image forming machine of claim 13, wherein the toner cartridge further comprises a flexible coupling to which a rotation force is transmitted from the main body even when the toner cartridge is moved together with the supporting members.

24. An image forming machine of claim 23, wherein the flexible coupling comprises:

a coupling body connected to a driving source of the main body;

a coupling gear connected to a passive gear of the toner cartridge; and an media disc transferring a power of the driving source and causing the coupling gear to move by a predetermined distance in a radial direction of the medium disc.

25. A process cartridge mounted in a main body of an image forming apparatus to supply a toner to a developing roller to develop an electrostatic latent image formed on a photoconductive drum, comprising:

a drum cartridge mounted in the main body;

a toner cartridge having the developing roller communicating with the photoconductive drum, and slidably mounted in the main body in a direction parallel to a rotating axis of the developing roller;

support members mounted on both sides of the toner cartridge to support and guide the toner cartridge in the main body so that the developing roller moves linearly with respect to the photoconductive drum;

a press unit moving the developing roller of the toner cartridge toward the photoconductive drum when the toner cartridge is slidably mounted in the main body;

a driving source; and a flexible coupling unit flexibly coupling at least one of the developing roller and the photoconductive drum to the driving source.

26. The process cartridge of claim 25, wherein the toner cartridge further comprises a case containing the developing roller and having the both sides of the toner cartridge movably coupled to the corresponding ones of the support members.

27. The process cartridge of claim 26, wherein the case comprises one of a shaft and a hole formed thereon, and the support member comprises the other one of the shaft and the hole formed thereon.

28. The process cartridge of claim 27, wherein:

the main body comprises, a groove, a first position determining pin, and a second position determining pin;

one of the support members comprises, a first portion having a first position determining hole which receives the first position determining pin; and the other one of the support member comprises, a second portion having a second position determining hole which receives the second position determining pin.

29. The process cartridge of claim 26, wherein the case comprises a step portion, and the press unit pushes the step portion of the case when the case is inserted into the main body, so that the developing roller of the case is pushed toward the drum cartridge.

30. The process cartridge of claim 26, wherein the case comprises first and second steps, and the press unit comprises first and second sub-press units corresponding to the first and second steps, respectively.

31. The process cartridge of claim 30, wherein the main body comprises a toner cartridge mounting portion having a surface defining a space accommodating the toner cartridge in a direction parallel to a rotation axis of the developing roller, and the first and second steps are arranged in the direction parallel to the rotation axis of the developing roller.

32. The process cartridge of claim 25, wherein the flexible coupling unit comprises:

a driving gear rotatably mounted on the toner cartridge to rotate the developing roller, and having a connecting pin; and a medium disc rotatably mounted on the toner cartridge, and having a plurality of slots into which the connecting pin and a shaft of the driving source are inserted into corresponding ones of the slots when the toner cartridge is inserted into the main body, to transfer a rotation force of the driving source to the developing roller through the medium disc and the driving gear.

33. The process cartridge of claim 32, wherein the flexible coupling unit further comprises a passive gear connected to the driving gear to rotate the developing roller according to a rotation of the driving gear.

34. A process cartridge mounted in a main body of an image forming apparatus to supply a toner to a developing roller to develop an electrostatic latent image which is formed on a photoconductive drum, comprising:

a toner cartridge having the developing roller and slidably mountable in the main body to communicate with the photoconductive drum;

a support member in which the toner cartridge is movably disposed, and supporting and guiding the toner cartridge in the main body so that the developing roller moves linearly with respect to the photoconductive drum while the support member is in a stationary state with respect to the main body; and a press unit including at least two elastic members disposed at different locations along a length of the toner cartridge and at different distances from a rotational axis of the developing roller and moving the developing roller of the toner cartridge with respect to the support member toward the photoconductive drum when the toner cartridge is mounted in the main body.

35. A process cartridge mounted in a main body of an image forming apparatus to supply a toner to a developing roller to develop an electrostatic latent image which is formed on a photoconductive drum, comprising:

a toner cartridge having the developing roller and slidably mountable in the main body to communicate with the photoconductive drum, and mounted in the main body;

a support member in which the toner cartridge is movably disposed, supporting and guiding the toner cartridge in the main body, and being in a stationary state with respect to the main body while the toner cartridge is movable with respect to the main body;

a pressing unit disposed between the toner cartridge and the main body at a rear side of the toner cartridge opDosite to the photoconductive drum and including at least one recess disposed on the main body and at least one elastic member disposed in the at least one recess to press the toner cartridge toward the photoconductive drum.

36. The process cartridge of claim 35, wherein the main body comprises a driving source and a shaft receiving a rotation force from the motor, and the process cartridge further comprises:

a flexible coupling unit disposed on a side of the toner cartridge, and having a driving gear rotatably mounted on the toner cartridge to rotate the developing roller and having a connecting pin, and a medium disc rotatably mounted on the toner cartridge and having a plurality of slots receivable the connecting pin and the shaft of the driving source to transfer the rotation force of the driving source to the developing roller through the medium disc and the driving gear.

37. An image forming apparatus to supply a toner to a developing roller to develop an electrostatic latent image formed on a photoconductive drum, comprising:

a main body having first and second cartridge mounting portions fluidly communicating with each other;

a drum cartridge removably mounted in the first mounting portion and having a photoconductive drum exposed outward;

a toner cartridge removably mounted in the second mounting portion, and having a developing roller exposed outward, the toner cartridge being mounted without interruption between the developing roller and the photoconductive drum, and contacting the photoconductive drum when being completely mounted;

a support member to which the toner cartridge is movably connected, and supporting and guiding the toner cartridge to be inserted into the main body so that the developing roller moves linearly with respect to the photoconductive drum;

a press unit moving the developing roller of the toner cartridge toward the photoconductive drum when the toner cartridge is slidably mounted in the main body;

a driving source; and a flexible coupling unit flexibly coupling at least one of the developing roller and the photoconductive drum to the driving source.

38. An image forming apparatus to supply a toner to a developing roller to develop an electrostatic latent image formed on a photoconductive drum, comprising:

a toner cartridge having the developing roller and slidably mountable in the main body to communicate with the photoconductive drum;

a support member in which the toner cartridge is movably disposed, supporting and guiding the toner cartridge in the main body, and being in a stationary state with respect to the main body while the toner cartridge is movable with respect to the main body; and a guide unit to guide movement of the toner cartridge in the Support member and including at least one pair of an elongated guide hole and a corresponding guide shaft disposed on an end of the toner cartridge such that the guide shaft is movable along the corresponding elongated guide hole when the toner cartridge is moved.

* * * * *